United States Patent [19]

Blessing

[11] 4,201,145

[45] May 6, 1980

[54] SEW LENGTH CONTROL AND MEASURING APPARATUS

[75] Inventor: Hubert Blessing, Dallas, Tex.

[73] Assignee: Levi Strauss & Co., San Francisco, Calif.

[21] Appl. No.: 907,800

[22] Filed: May 19, 1978

[51] Int. Cl.[2] ..... D05B 27/16

[52] U.S. Cl. ..... 112/306; 112/318; 112/322

[58] Field of Search ..... 112/211, 214, 210, 203, 112/208, 209, 121.26, 306, 322

[56] References Cited

U.S. PATENT DOCUMENTS

| | | | |
|---|---|---|---|
| 3,285,211 | 11/1966 | Hayes et al. | 112/214 |
| 3,425,377 | 2/1969 | Scharmer et al. | 112/214 X |
| 3,960,097 | 6/1976 | Block | 112/214 |
| 3,980,032 | 9/1976 | Kleinschmidt et al. | 112/121.26 X |
| 4,036,156 | 7/1977 | Becker et al. | 112/121.26 |

*Primary Examiner*—H. Hampton Hunter

[57] ABSTRACT

The lengths of at least a pair of limp workpieces fed through a work station are controlled by pressing each of the workpieces into engagement with a separate toothed wheel and by controlling the rotational velocity of one of the toothed wheels as a function of the rotational velocity of the other toothed wheel. In one preferred embodiment the contorl of the rotational velocities of the two wheels is accomplished by means of a differential gear and a motor which operates under the control of rates of feed sensors which monitor the rates of feed of the two workpieces.

10 Claims, 9 Drawing Figures

SEW LENGTH CONTROL AND MEASURING APPARATUS

CROSS-REFERENCE TO RELATED APPLICATION

This application is related to the co-pending patent application Ser. No. 894,030, filed Apr. 6, 1978, entitled ACTUAL SEW LENGTH MEASURING DEVICE, now U.S. Pat. No. 4,171,575, issued Oct. 23, 1979.

BACKGROUND OF THE INVENTION

This invention relates to apparatus for controlling the feeding of fabric workpieces to a commercial sewing station and more particularly to a device for controlling the length of a pair of workpieces as they are sewn together by a commercial sewing machine.

DESCRIPTION OF THE PRIOR ART

For sewing cut parts to each other such as in the manufacture of pants or jackets, sewing machines having bottom and top feed devices are used so that too overlying workpieces may be simultaneously fed through the sewing machine. Since it is usually desirable that the workpieces be fed through at the same rate, various apparatus have been proposed for monitoring the rates of feed of the workpieces and for controlling them with respect to each other. See, for example, U.S. Pat. Nos. 3,954,071 (Mall, et al.), 4,037,546 (Kleinschmidt) and 3,867,889 (Conner). In the devices disclosed in all of these patents either the rates of feed of the workpieces are monitored (Mall) or the relative positions of the workpieces with respect to each other are monitored and a control signal is generated to adjust the feed rates of the top and bottom feed dogs of the sewing machine in order to cause the two workpieces to be fed at the same rate and to ultimately end up with their ends parallel and sewn together. Thus, all these devices require a relatively complex and cumbersome differential feed dog mechanism in the sewing machine and reasonably complex electronic control circuits to monitor the workpieces as they are fed through the sewing machine.

No provision is made for intentional differential feed rates for the workpieces. In sewing a three dimensional garment, it is necessary to feed one of the workpieces at a rate which is greater than the rate of feed of the other workpiece. With the apparatus described in the foregoing patents this is not possible since the whole object is to feed the two workpieces at the same rate.

SUMMARY OF THE INVENTION

The foregoing disadvantages of prior art workpiece controlled rate of feed apparatus are overcome by the present invention comprising a pair of wheels, means for separately, rotatively supporting the wheels ahead of the sewing needle and for biasing each of them into rolling engagement with separate ones of a pair of fabric workpieces. The wheels are intercoupled by means for controlling the rotational velocity of one of the wheels as a proportion of the rotational velocity of the other wheel to thereby limit the rates at which the workpieces are pulled by the sewing machine feed dogs past the needle.

In one embodiment of the invention the wheels have toothed perimeters which grip the fabric workpieces as they roll over them. The wheel rotational velocity controlling means comprise at least a pair of inter-engaged gears which are each connected to a separate one of the work engaging wheels. These gears may have a ratio which is or is not equal to one, depending on whether it is desired to feed the workpieces at the same rate or different rates. Similarly the diameters of the wheels can be made equal or different to accomplish the same effect.

In one preferred embodiment of the invention the wheel rotational velocity controlling means comprise a motor and a differential gear having two inputs and an output. One of the workpiece engaging wheels is connected to drive one of the inputs of the differential gear, the motor is connected to control the other input to the differential gear, and the other workpiece engaging wheel is connected to the differential gear output. Means are provided for sensing the rates of feed of the workpieces and for controlling the motor to drive the differential gear, and hence the workpiece engaging wheels, so as to maintain a predetermined ratio of feed rates as between the two workpieces through the wheels.

It should be understood that in all of these embodiments, although the feed dogs of the sewing machine are attempting to pull the workpieces through the work station at a constant rate, the rate of feed of the workpieces is actually controlled by the wheels. To the extent that the rate of feed at the feed dogs exceeds the rotational velocity of the wheels the feed dogs simply slip over the workpieces. The feed dog speed must at least equal the circumferential velocity of the workpiece engaging wheels because they are turned principally by the moving fabric pulled by the feed dogs.

The mechanism for sensing the rate of feed of the workpieces can either be a series of photocell sensors or, more preferably, by monitoring the rotational velocity of the workpiece engaging wheels. Apparatus for doing this type of measurement is disclosed in the co-pending application entitled ACTUAL SEW LENGTH MEASURING DEVICE referred to above. In this apparatus a flexible shaft is connected between each of the workpiece engaging wheels and an incremental, digital counter. The counter has a count display, an input shaft, and pulse wheel means sensitive to the rotation of the input shaft for advancing the counter for each predetermined increment of rotation of the input shaft. The flexible shaft is connected at one end to one of the workpiece engaging wheels to rotate with it and at the other end to the pulse wheel generator which supplies the counter with a pulse for each predetermined increment of rotation of the workpiece engaging wheel.

A pair of such apparatus are each connected to a separate one of the wheels. The net counter output from both pairs of workpiece engaging wheels, that is, the difference between the counts in the pair of counters, is applied to drive the motor which, through the differential gear, drives the workpiece engaging wheels. Where a differential rate of feed is desired an offset count may be added continuously to the net counter output so that one of the wheels is allowed to rotate faster than the other.

It is an object of the present invention to provide apparatus for controlling the rates of feed and hence the sewn lengths of at least a pair of limp workpieces as they are drawn through a work station without the necessity of complicated differential feed dog mechanisms in the sewing machine.

It is another object of the invention to provide simple and reliable apparatus for allowing two limp workpieces to be fed to a work station for attachment to each other at differential rates of speed.

It is still another object of the invention to monitor the rates of feed of two workpieces to a work station where they are attached together and to simultaneously control the rate of feed of one workpiece as a function of the rate of feed of the other.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS

Figure 1:
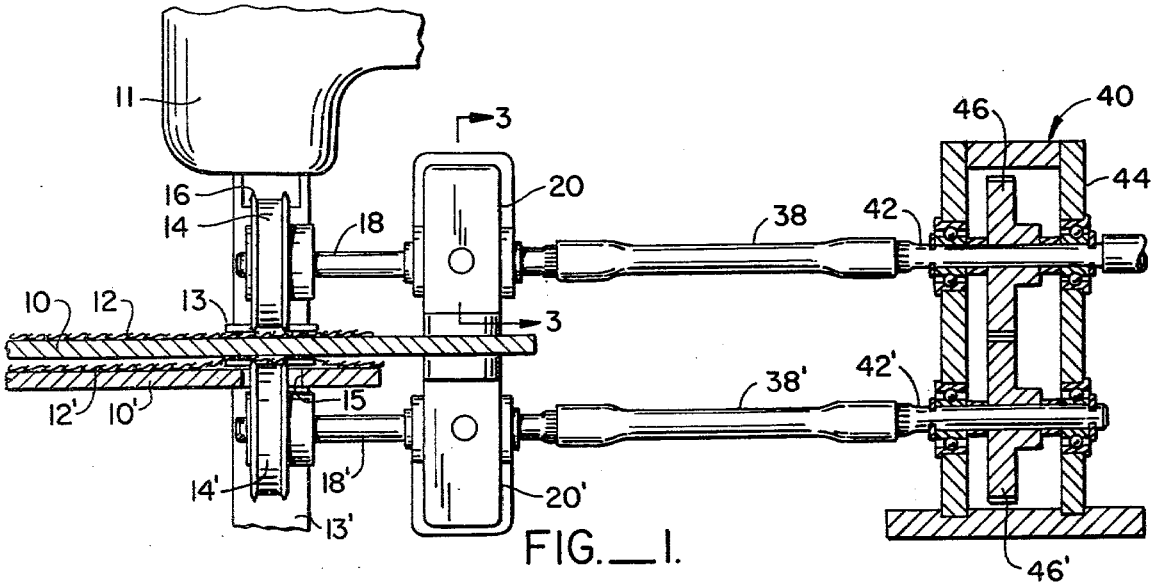
FIG. 1 is a vertical, sectional view, of one embodiment of the invention.

Referring now more particularly to FIG. 1, a limp fabric workpiece 12 rests on a horizontal workpiece support surface 10 which is part of an overall work station for processing the workpiece. An example of a typical such work station would be where a waistband part is sewn for incorporation into a pair of pants. The workpiece 12 is oscillated forth by an upper feed dog 13 or a lower feed dog (not shown) of a sewing machine 11 at a predetermined frequency. In the present garment field, this frequency can be as high as 7,000 cycles per minute.

A workpiece engaging wheel 14 having a plurality of spines of teeth 16 about its circumference rolls against the workpiece 12. The wheel 14 is fixedly mounted on a shaft 18 which is rotatably carried in an assembly 20. The assembly 20 is bolted to the work surface 10 at a position to place the wheel 14 upstream from the feed dog 13 (or the pressure foot), taken with respect to the direction of travel of the workpiece as it is pulled through the sewing machine by the feed dog(s).

Figure 3:
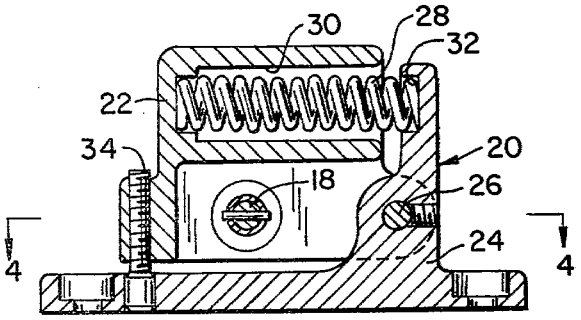
FIG. 3 is an enlarged, vertical, sectional view of a portion of the apparatus taken generally along the lines of 3—3 in FIG. 1.
Figure 4:
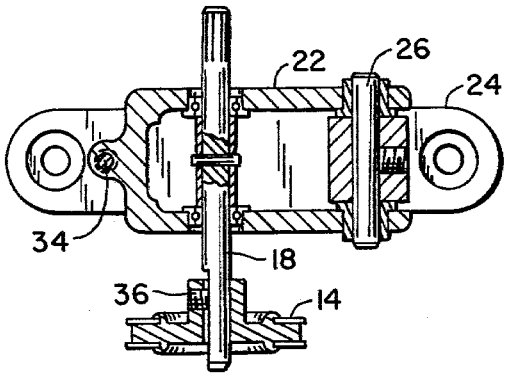
FIG. 4 is an enlarged, horizontal, sectional view taken generally along the lines of 4—4 in FIG. 3.

Referring more particularly to FIGS. 3 and 4, it can be seen that the shaft support assembly 20 resiliently biases the toothed wheel 14 into rolling engagement with the workpiece 12. This is accomplished by having a stationary block 24 and a pivoted or hinged part 22. The part 22 is hinged to the part 24 by means of a horizontal pin 26 passing through both members and carries the shaft 18. A coil spring 28, one end of which is received in a cavity 30 in the hinged part 22 and the other end of which rests in a recess 32 in the part 24, biases the hinged part 22 to lower the shaft 18 until the toothed wheel is against the workpiece 12. An adjustment screw 34 threaded in the hinged part 22 and bearing against the stationary part 24 allows adjustment of the height, and hence of the pressure, of the toothed wheel with respect to the workpiece 12. As best viewed, in FIG. 4, it can be seen that the toothed wheel 14 is keyed to the shaft 18 by means of a set screw 36. The end of the shaft 18 on the opposite side of the part 22 from the wheel 14 is splined to receive a tube 38 of flexible material.

Beneath the support surface 10 is a second workpiece 12′ supported on a support surface 10′ and which is drawn through the sewing machine by a lower feed dog 13′. Thus, the support surface 10 separates the two workpieces 12 and 12′. The support surface 10′ is provided with an aperture 15 through which a second toothed wheel 14′ passes to roll on the workpiece 12′. The toothed wheel 14′ is mounted on a second shaft 18′ which is rotatably carried in an assembly 20′ and which is connected at one end to a flexible tube 38′. The construction of the workpiece engaging wheels 14 and 14′ and their supporting apparatus 18, 18′, 20 and 21′ are substantially identical and therefore have been given corresponding reference numerals primed.

The shafts 18 and 18′ of the wheels 14 and 14′ are connected by the flexible tubes 38 and 38′ to a gear assembly 40. The purpose of the gear assembly 40 is to fix the rotation of one of the wheels with respect to the other. For this reason, one end of the flexible tube 38 is connected to one end of a shaft 42 which is rotatably mounted in a housing 44. Mounted on the shaft 42 within the housing 44 is a gear 46. The flexible tube 38′ is similarly connected to one end of a shaft 42′ which is rotatably mounted in the housing 44. A gear 46′ is attached to the shaft 42′ and meshes with the gear 46. In this way the wheels 14 and 14′ counter-rotate and the ratio of their rotational speeds is fixed by the ratio of the gears 46 and 46′. If the gears 46 and 46′ have a ratio other than one, one of the wheels (14 or 14′) will rotate faster than the other, but in a fixed ratio of rotational speeds.

Figure 2:
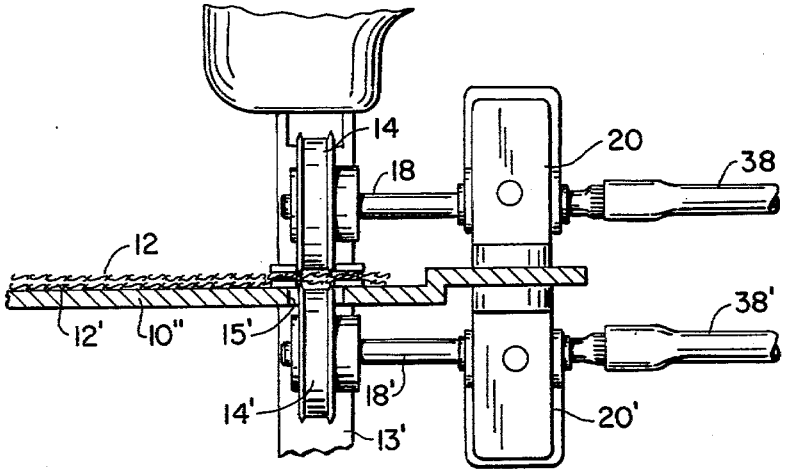
FIG. 2 is a vertical, sectional view of a second embodiment of the invention.

When the two wheels 14 and 14′ are caused to rotate at the same speed, equal lengths of workpieces 12 and 12′ will be fed through the sewing machine 11. If the ratio of the gears 46 and 46′ is unequal, one of the workpieces 12 or 12′ will be caused by the work engaging wheel 14 or 14′, respectively, to move at a faster rate and hence two workpieces of unequal length will be sewn together. This may be done, for example, where a three-dimensional garment piece is to be sewn. Similarly the diameter of the wheel 14 may be made larger or smaller than the diameter of the wheel 14′ to achieve the same differential feed rate effect.

Where it is desired to feed the two workpieces 12 and 12′ at the same rate, so that the wheels 14 and 14′ are either dimensional or are geared to rotate at the same rate, then the structure depicted in FIG. 2 can be utilized wherein the workpieces 12 and 12′ are laid one on top of the other on a work support surface 10″ against the workpiece 12′. Although not shown in FIG. 2, it is to be understood that the flexible tubes 38 and 38′ are connected to a gear assembly 40 which has gears 46 and 46′ having an equal ratio.

Figure 5:
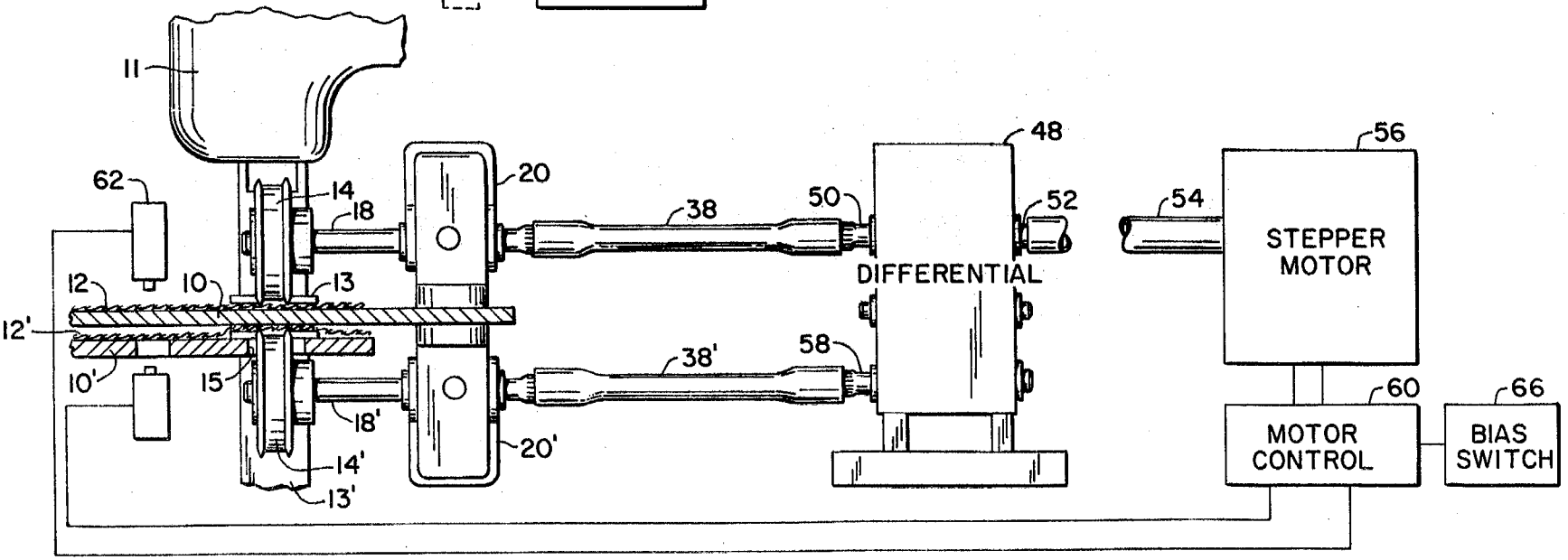
FIG. 5 is a diagrammatic view of a second embodiment of the invention.

Referring now more particularly to FIG. 5, still another embodiment of the invention is depicted wherein the ratio of the rotational speeds of the workpiece engaging wheels 14 and 14′ can be varied continuously in order to feed the workpieces 12 and 12' at feed rates having a predetermined ratio. The support structure of the workpiece engaging wheels 14 and 14', and the workpieces 12 and 12' is substantially identical to that described in reference to FIG. 1. The flexible tubes 38 and 38', however, instead of being connected to the gear assembly 40, are connected to a differential gear 48.

In the normal arrangement of a differential gear, the gears are in an epicyclic train that connects two shafts or axles in the same line, divides a rotating driving force equally between them, and permits one shaft to revolve faster than the other. If one of the ends of the divided shaft is instead connected to a separate driver rotating at a different speed, then the other end of the shaft will have an output speed which is either the sum or the difference of the two input driving speeds, depending on their direction of driving rotation with respect to each other. Since such differential gears and their construction are well known to those skilled in the art, see for example U.S. Pat. No. 3,925,713, particularly FIG. 5 thereof, the differential gear 48 will not be described in further detail.

Referring again to FIG. 5, the flexible tube 38 is connected to a shaft end 50 of the differential gear 48. The shaft 50 is divided within the differential gear and the other end of the shaft, denoted by the numeral 52, is connected by means of a flexible tube 54 to the output of a motor 56 which can be a stepping motor for example. One input of the differential gear 48 is supplied by a shaft 58 connected to the tube 38'. In operation, if the shaft end 52 is held stationary, then the differential gear 48 has a gear ratio such that rotation of shaft 58 will be directly outputed on the shaft 50 at the same rotational speed so that the wheels 14 and 14' will counter-rotate with the same rotational velocity and the workpieces 12 and 12' will be fed through the sewing machine 11 at the same feed rates. If a rotational driving force at a particular speed is applied by the motor through the tube 54 to the shaft end 52 in a given direction, this speed will be subtracted (or added, depending on the direction of rotation) to the driving speed of the shaft 58 and the difference (or sum) of the two driving speeds will be output on the shaft 50 through the tube 38 and the shaft 18 to the wheel 14. Since this rotational velocity will be different than the rotational velocity of the wheel 14', the two wheels will counter-rotate at different speeds and a differential rate of feed of the workpieces 12 and 12' will be accomplished.

A motor control circuit 60 is used to control the output speed of the motor so that it will supply the appropriate driving force via the tube 54 and the shaft 52. The motor control circuit 60, in turn, is controlled by means of a pair of sensors 62 and 64 which are mounted above and below the work support surface 10, respectively, to sense the motion of the workpieces 12 and 12'. These sensors 62 and 64 may be photo-optic sensors which detect the passage of marks imprinted linearly along the workpieces in the direction of feed or they may be linear-scanned, photodiode arrays which are able to measure the length of the workpiece beneath it. In either case, the outputs of the sensors 62 and 64 are digital signals proportional to the rate of change of the sensed length of the workpieces 12 and 12', i.e., their velocity beneath the sensors 62 and 64.

The motor control takes the difference of these output signals and supplies an appropriate control signal to the motor 56 to cause it to equalize the rates of feed of the workpieces 12 and 12' as described above. The motor control 60 can also be supplied with a bias by means of a thumb wheel bias switch 66 which is connected to the motor control 60. The bias switch 66 supplies a constant difference signal which is added to the difference of the outputs of the sensors 62 and 64.

Figure 6:
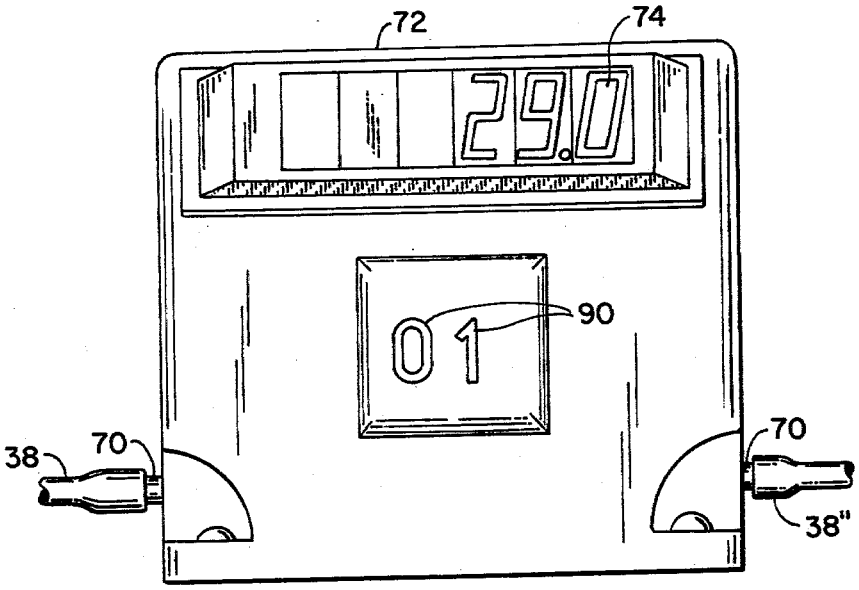
FIG. 6 is a front view in elevation of a measuring counter for use with the apparatus of the invention.
Figure 7:
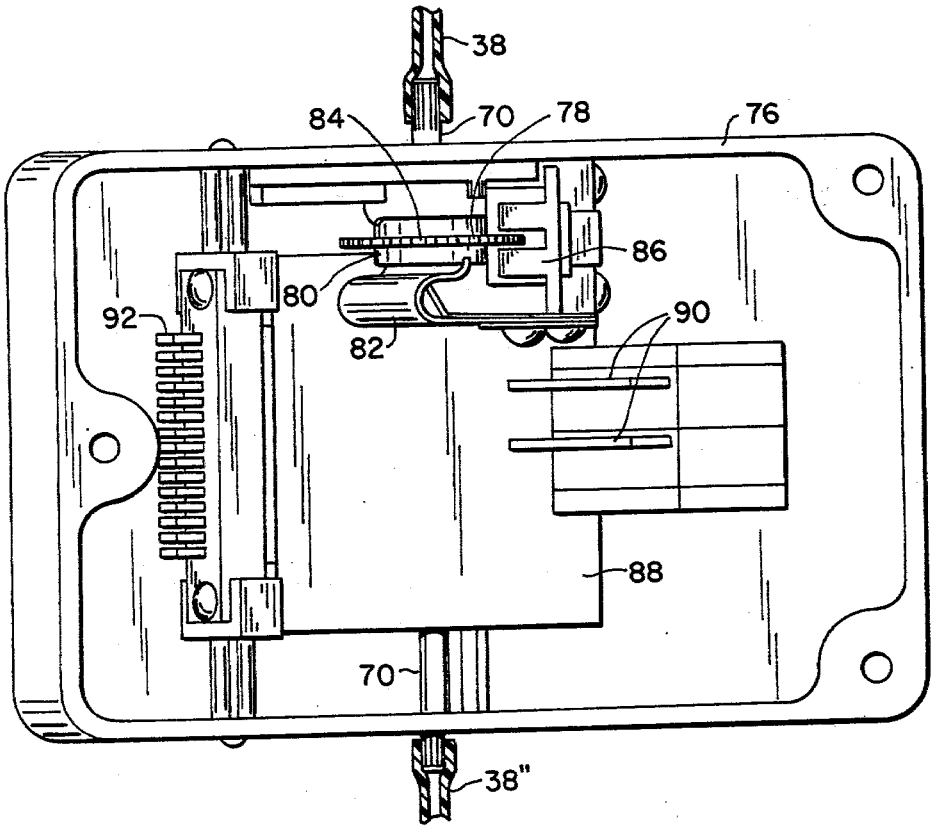
FIG. 7 is an enlarged, diagonal section view of the counter depicted in FIG. 7.

Referring now more particularly to FIG. 6, a more accurate way of measuring the fabric length is illustrated. In this apparatus, a sensor-counter 72 is interposed between the workpiece engaging wheel 14 and the differential gear 48. This is accomplished by connecting the end of the flexible shaft 38 to an input shaft 70 of the sensor-counter 72. The shaft 70 passes through the sensor-counter 72 and emerges from the opposite side where it is again connected to a flexible tube 38" which is connected to the shaft 50 of the differential gear 48.

Sensor-counter 72, as will be explained in greater detail hereinafter, includes an electronic counter 88 having a display 74 on the face of the indicator housing 76. Thumb wheel switches 90 on the face of the housing 76 allow the counter to be calibrated or an offset entered.

The shaft 70 is rotatably supported between the sidewalls of the casing 76. A disc 78, within the housing 76, is mounted on the shaft 70. The disc 78 has a plurality of apertures 84 about its circumference. A disc brake 80 bears against the flat side of the disc 78 opposite from the end of the shaft 70. A spring 72 presses the disc brake 80 against the disc 78. The spring 82 is attached to the casing 76. The purpose of the disc brake 80 is to provide frictional drag on the disc 78 to prevent it from rotating backwards when the needle is pulled out of the fabric after making a stitch. Backwards rotation would produce an erroneous count. During this period, the fabric workpiece 12 relaxes and tends to contract somewhat which, without the disc brake 80, would add to the count within the indicator 72, giving an erroneous reading. To further prevent any such backlash, the shaft 38 when so connected is chosen of a material and of a length such that its tuned torsional frequency, when coacting with the brake 80, is at least equal to 7,000 cycles per minute. An example of such a material is hollow, natural polyethylene plastic tubing, such as that made by Imperial Eastman Company, type No. 44-P. The free length of a typical one of such tubes is two and three quarters inches. The inner diameter of the tubing is three sixteenths of an inch and the outside diameter is one quarter inch.

A slotted photo-optic coupler sensor 86 straddles the outer circumference of the disc 78 and produces an electronic pulse output with the passing of each aperture 84 through the coupler 86. The photo-optic coupler sensor 86 is connected by means of wires (not shown) to the high speed, electronic counter 88. The electronic counter 88 counts, in binary fashion, the pulses from the photo-optic coupler sensor 86 and displays a decimal count on the display 74. Since the counter 84 is a commercially manufactured item, its circuitry will not be described in greater detail. An example of such a counter is counter Model No. PC-4, manufactured by Non-Linear Systems, Inc.

The counter 88 is supplied with the necessary voltages and inputs by means of printed circuit connectors 92. The power supplies and other necessary operative circuitry which are ordinarily used with such counters are not shown but they are understood to be included. Since they are commonplace and readily, commercially available, they also will not be described in any greater detail.

Figure 8:
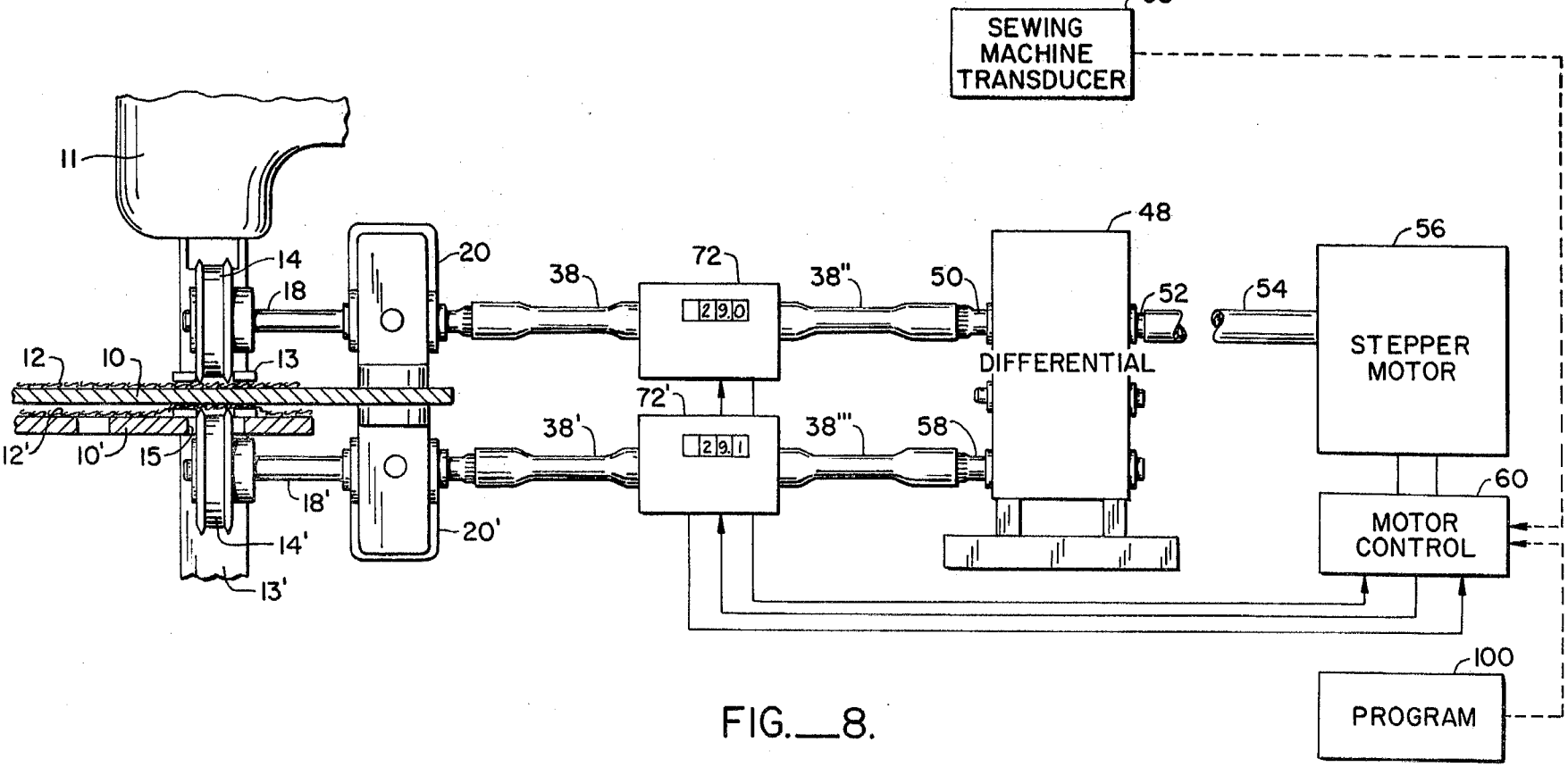
FIG. 8 is a diagrammatic view of a third embodiment of the invention.

Referring now to FIG. 8, an identical sensor-counter 72' is also interposed in the flexible tube 38'. The outputs of the sensor-counters 72 and 72', that is, the digital representation of the number of pulses counted by the counters 88 and 88', are fed to the motor control 60, in place of the outputs from the sensors 62 and 64 which are not used, and the motor control subtracts these two counts to provide a net sum. The motor control 60 uses this net sum to control the motor 56 to drive the differential gear 48 so as to reduce this net difference to either zero, in the case where the fabric workpieces 12 and 12' are fed at equal rates, or to reduce it to a constant difference where the workpieces are to be fed at different rates for purposes of ruffling, for example.

Figure 9:
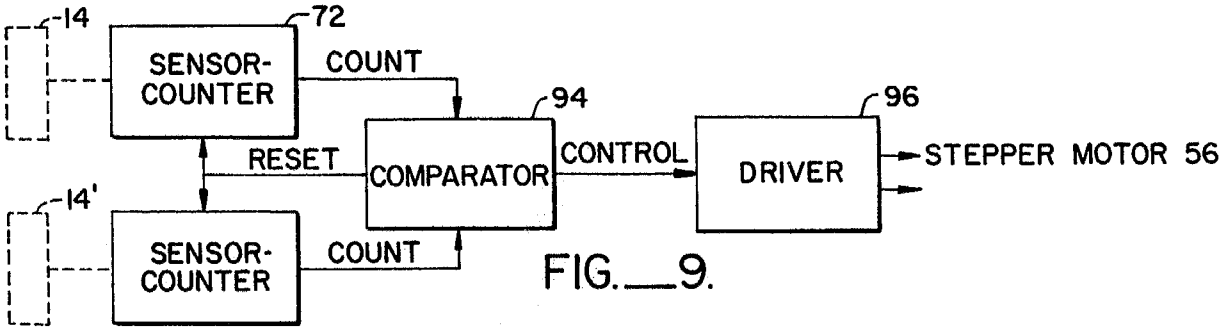
FIG. 9 is a block diagram of a portion of the embodiment depicted in FIG. 8.

The motor control is briefly illustrated in FIG. 9 as comprising a comparator 94 for receiving the counts from the counters 88 and 88', within the sensor-counters 72 and 72', and for producing a control signal to a motor driver circuit 96 which drives the motor 56, and hence the wheels 14 and 14', in a direction and at a rate which tends to null the control signal from the comparator 94. The first of the counters 88 or 88' to reach a predetermined count causes the comparator 94 to electronically reset both counters to zero. The further details of the comparator and motor control circuit are not described since such circuits are well known to those skilled in the art; see, for example, U.S. Pat. No. 3,867,889, in particular FIGS. 9 and 10.

While in the above-described embodiment the motor 56 is operated by sensing the rates of feed of the workpieces 12 and 12' in other embodiments where it is desired to match up the ends of workpieces of uneven lengths; for example, a sensor, such as that described in U.S. Pat. No. 4,037,546, can be utilized to detect the position of the end of one workpiece relative to the end of the other and can control the motor 56 so as to drive the wheels 14 and 14' to keep the workpiece ends parallel.

In some embodiments it is desirable to limit the amount of correction which is provided by the guide wheels 14 and 14' to the stitch rate. If too much correction is provided with respect to the stitch rate, pleating in some instances, might occur. To prevent this, a sensor 98 mounted on the sewing machine produces a pulsed output signal whose pulse rate is proportional to the sewing speed. The sensor can be of the induction type or the photo optic type, for example, and can be mounted adjacent to the needle bar, for example, or at any other appropriate place on the sewing machine to sense the reciprocation of the sewing mechanism. Such sensors are conventional and therefore will not be explained in further detail. The sensor output is supplied to the motor control 60, as indicated in dashed line fashion in FIG. 8, and is used to limit the amount of corrective action taken by the guide wheels 14 or 14' to a predetermined ratio of the stitch rate. This can be accomplished by conventional electronic digital counting and logic gate circuitry or by the use of a microprocessor.

Still another modification is to independently generate guide wheel control signals from an independent program 100. This program 100 can be a programmed microprocessor, for example, or simply a sensor detectable pattern which is moved in synchronism with the workpiece relative to the detector. The use of the program can be combined with the sensor 98 so that, for example, the guide wheels 14 and 14' are caused to rotate and provide guidance to the workpieces after a predetermined number of stitches have been sewn, as counted by the motor control 60 through the sensor 98.

The terms and expressions which have been employed here are used as terms of description and not of limitation, and there is no intention, in the use of such terms and expressions of excluding equivalents of the features shown and described, or portions thereof, it being recognized that various modifications are possible within the scope of the invention claimed.

What is claimed is:

1. In combination with a sewing machine of the type having reciprocating feed dog means for drawing one or multiple limp workpieces through the sewing machine, apparatus for controlling the lengths of the workpieces as they are drawn through the sewing machine, the controlling apparatus comprising a pair of wheels, means for separately, rotatably supporting the wheels and for biasing each of them into rolling engagement with a separate one of the workpieces, means for intercoupling the wheels to control the rotational velocity of one of the wheels as a proportion of the rotational velocity of the other wheel, and wherein the controlling apparatus is attached to the sewing machine ahead of the feed dog means taken in the direction of travel of the workpieces through the sewing machine.

2. Workpiece length controlling apparatus as recited in claim 1, wherein the wheel intercoupling means comprise at least a pair of interengaged gears which are each connected to a separate one of the wheels.

3. Workpiece length controlling apparatus as recited in claim 2, wherein the pair of gears have a ratio other than one.

4. Workpiece length controlling apparatus as recited in claim 2, wherein the pair of gears have a ratio equal to one.

5. Workpiece length controlling apparatus as recited in claim 1, wherein the diameter of one of the wheels is less than the diameter of the other.

6. Workpiece length controlling apparatus as recited in claim 1, wherein the diameters of the wheels are equal.

7. Apparatus for controlling the lengths of one or multiple limp workpieces as they are drawn through a work station, the controlling apparatus comprising a pair of wheels, means for separately, rotatably supporting the wheels and for biasing each of them into rolling engagement with a separate one of the workpieces, and means for intercoupling the wheels to control the rotational velocity of one of the wheels as a proportion of the rotational velocity of the other wheel, the wheel intercoupling means including a motor, a differential gear having two inputs and an output and wherein one of the wheels is connected to drive one of the inputs of the differential gear, the motor is connected to control the other input to the differential gear, and the other wheel is connected to the differential gear output.

8. Workpiece length controlling apparatus as recited in claim 7, further comprising means for sensing the rates of movement of the workpieces relative to each other, and for generating a sensor signal representative of the sensed rates and means supplied with the sensor signal for controlling the motor to drive the differential gear, and hence the wheels, so as to maintain a predetermined ratio of feed rates as between the two workpieces.

9. Workpiece length controlling apparatus as recited in claim 8, wherein the rate sensing means comprise separate pulse generator means connected to each wheel for generating an electronic pulse signal for each predetermined increment of rotation of each wheel and resettable counters for counting the numbers of pulses from the pulse generators, and wherein the motor control means comprise a comparator for intermittently comparing the counts in the counters and for generating a control signal which is representative of the difference between the compared counts, and means supplied with this count difference control signal for controlling the speed and direction of rotation of the motor so as to attempt to null the count difference control signal by decreasing the rotation of the faster rotating one of the wheels.

10. Workpiece length controlling apparatus as recited in claim 7 wherein the work station comprises a reciprocating tool which acts on the workpieces, means for sensing the rate at which the tool is reciprocated and for producing a pulsed output signal whose pulse rate is proportional to the reciprocation rate, and means supplied with the pulsed output signal for controlling the motor in accordance therewith.

* * * * *